US005620660A

United States Patent [19]

Belgardt et al.

[11] Patent Number: 5,620,660

[45] Date of Patent: Apr. 15, 1997

[54] PIPETTE SYSTEM

[75] Inventors: Herbert Belgardt, Hamburg; Rolf-Günter Meyer, Bendestorf, both of Germany

[73] Assignee: Eppendorf-Netheler-Hinz GmbH, Hamburg, Germany

[21] Appl. No.: 345,671

[22] Filed: Nov. 28, 1994

[30] Foreign Application Priority Data

Dec. 3, 1993 [DE] Germany ..... 43 41 229.7

[51] Int. Cl.[6] ..... B01L 3/02

[52] U.S. Cl. ..... 422/100; 422/101; 422/103; 422/104; 73/864.13; 73/864.32; 403/368

[58] Field of Search ..... 422/100, 101, 422/103, 104; 73/864.01, 864.13, 864.14, 864.32; 403/368–371, 377, 378

[56] References Cited

U.S. PATENT DOCUMENTS

| | | | |
|---|---|---|---|
| 4,054,062 | 10/1977 | Branham | 73/425.6 |
| 4,099,548 | 7/1978 | Sturm et al. | 141/27 |
| 4,151,750 | 5/1979 | Suovaniemi et al. | 73/425.6 |
| 4,187,724 | 2/1980 | Citrin | 73/425.4 P |
| 4,257,267 | 3/1981 | Parsons | 73/425.6 |
| 4,283,950 | 8/1981 | Tervamaki | 73/864.14 |
| 4,399,712 | 8/1983 | Oshikubo et al. | 73/864.16 |
| 4,418,580 | 12/1983 | Satchell et al. | 73/864.13 |
| 4,616,514 | 10/1986 | Magnussen et al. | 73/864.14 |
| 4,679,446 | 7/1987 | Sheehan et al. | 73/864.13 |
| 4,744,955 | 5/1988 | Shapiro | 422/100 |
| 4,763,535 | 8/1988 | Rainin et al. | 73/864.18 |
| 4,784,834 | 11/1988 | Hirschmann | 422/100 |
| 4,830,832 | 5/1989 | Arpagaus et al. | 422/65 |
| 4,999,164 | 3/1991 | Puchinger et al. | 422/100 |
| 5,104,624 | 4/1992 | Labriola | 422/100 |
| 5,104,625 | 4/1992 | Kenney | 422/100 |
| 5,111,703 | 5/1992 | Allen | 73/864.11 |
| 5,143,849 | 9/1992 | Barry et al. | 436/50 |
| 5,200,151 | 4/1993 | Long | 422/100 |
| 5,213,764 | 5/1993 | Kerr et al. | 422/100 |
| 5,249,711 | 10/1993 | Filbert | 222/189 |
| 5,330,721 | 7/1994 | Tervamaki | 422/100 |
| 5,364,596 | 11/1994 | Magnussen et al. | 422/100 |
| 5,389,341 | 2/1995 | Tuunanen et al. | 422/100 |

FOREIGN PATENT DOCUMENTS

| | | |
|---|---|---|
| 77180 | 10/1982 | European Pat. Off. . |
| 22686 | 7/1986 | European Pat. Off. . |
| 2736551 | 8/1977 | Germany . |
| 2926691 | 7/1979 | Germany . |
| WO15837 | 8/1993 | WIPO . |

*Primary Examiner*—James C. Housel
*Assistant Examiner*—Harold Y. Pyon
*Attorney, Agent, or Firm*—Anderson Kill & Olick P.C.

[57] ABSTRACT

A manually pipette system including a replacement syringe having a mounting part and a plunger, a manual pipette having a space for receiving the syringe mounting part and a receiving body having a cavity for receiving the syringe plunger, with the mounting part and the plunger being movable into their attachment positions upon relative axial displacement of the syringe and the pipette, and syringe and plunger gripping levers for releasably securing the mounting part and the plunger in their attachment positions.

15 Claims, 2 Drawing Sheets

PIPETTE SYSTEM

BACKGROUND OF THE INVENTION

1. Field of the Invention

The present invention relates to a pipette system including a syringe having a mounting part and a syringe plunger, and hand pipette having means for receiving the syringe mounting part and means cooperating with the syringe plunger.

2. Description of the Prior Art

Pipette systems of the type referred to at the beginning often are defined as repeating or multipipette systems which allow the gradual delivery of a liquid from a syringe. Such a repeating pipette system is known from the DE-C2 29 26 691 which especially is directed to the repeating mechanism of the repeating pipette. It also describes how to secure a syringe of the system to said repeating pipette. For this purpose, the syringe is provided with a syringe flange adapted to be inserted from the side into a substantially U-shaped groove being open at the side. An axial pressure spring secures the inserted syringe flange to the nut. For the connection of the syringe plunger to a plunger adjusting means an insertion element is provided which receives an end section of the syringe plunger between two jaws. The jaws can be pressed against said syringe plunger by means of a flap-like clamping element, the actuating lever of which projects from the body through an opening. This way of fixing the syringe has the disadvantage that the syringe needs to be touched for inserting it and connecting the plunger adjusting means. There, however, are made high demands on the cleanness of the syringe. It is already manufactured on clean-room conditions and usually needs to be sterile. The syringe also needs to be touched when taking out the liquid which may involve a risk as a result of any adherent liquid.

From the CH 671 526 A5 and the EP 0 226 867 A2 a pipette system has become known comprising a syringe which, with the syringe flange and the syringe plunger, is axially movable in positions of attachment of accommodations. Therefore, fastening means in the form of first gripping means and second gripping means with slotted end sections are provided which are snapped on the flange of the syringe body and an annular portion of the syringe plunger. For this purpose, the syringe body first is inserted into the first gripping means and then the second gripping means is moved so as to snap on the pipette plunger. After pipetting the syringe is ejected by first pressing the syringe body out of the end section of the pipette by moving forward the second gripping means and, by moving forward said end sections of the second gripping means still further, causing it to expand by an expanding sleeve and release the plunger of the syringe.

According to this automatic device, the elastic restoring forces of the slotted end sections need to be overcome for fastening or detaching the syringe. Said slotted end sections need to be big enough to prevent the syringe from completely or partly slipping from its attachment when drawing in or delivering a liquid. Besides, the syringe can only be inserted and ejected with the plunger of the syringe being completely pressed in because the second gripping means are required to move forward towards the syringe in both cases.

The U.S. Pat. No. 4,616,514 and the WO 93/15837 also relate to systems comprising self-elastic coupling elements.

Taking all this as a basis, it is the object of the invention to provide a pipette system for manual operation which allows an easier and more reliable connection of the syringe to the pipette and an easier separation of the syringe from the pipette without having to be touched by the user and which offers an enlarged range of application.

SUMMARY OF THE INVENTION of the object of the invention is achieved by providing fastening means for releasably connecting the syringe and the pipette which fastening means comprises manually operated and radially displaceable gripping levers.

According to an inventive pipette system, the flange receiving means and plunger receiving means are provided with one axial opening each. The syringe with its mounting part and syringe plunger can be moved axially only through the axial openings directly to the positions of attachment of said mounting part and syringe plunger. The mounting part and syringe plunger are secured by radially movable gripping means which e.g. grip a syringe flange of the syringe and a plunger collar of the syringe plunger in the positions of attachment. With these features of the pipette system it is achieved that the syringe and hand pipette can be interconnected by an all-axial relative movement and can be separated from each other by an actuation of the fastening means. Thereat the syringe may be held in a stationary position, for instance within a mount, so that the connection and separation process requires manipulations of the hand pipette only. As a result of the axial movement the gripping means can be controlled automatically when the syringe and the hand pipette are connected to each other. Needless to say that the syringe can also be ejected by loosening the fastening means, for instance under the influence of gravity. In any case, the connection and separation of the syringe and hand pipette does not make any manipulation of the syringe necessary any longer. Thus, a contamination of the syringe and the user practically are impossible. Preferably, the pipette system is carried out as a repeating pipette system.

The axial arrangement of the gripping means allows the latter, irrespective of a spring resistance to be overcome during insertion, to positively and hence safely hold the syringe in the positions of attachment of said mounting part and said syringe plunger. The spring resistances can be selected user-optimized is spring means are forcing the gripping means into the position of attachment. Moreover, the axially arranged gripping means, on principle, can be activated regardless of the axial position of the displaceable receiving body within the pipette body so that completely or partly filled syringes can be secured to the hand pipette or separated therefrom. Thus, according to the invention, a pipette system had been provided which, especially, supports the manual operation and enlarges the range of application.

Preferably, the mounting part or syringe in its receiving abuts against abutments and is fixed thereto by the gripping means by engaging it round. Therefor the mounting part may comprise a syringe flange while the plunger may comprise a plunger collar. Furthermore, the gripping means may be gripping levers. The syringe gripping lever may comprise a hook-shaped gripping end for engaging round the mounting part. Plunger gripping levers having a wedge-shaped gripping end preferably are provided for engaging round a plunger. Said gripping levers may be double-armed and comprise one gripping arm as well as one operating arm.

Spring means may force the gripping means into the locking position. Syringe gripping levers then may be forced into their locking position by means of stationary leaf springs. For the plunger gripping levers leg springs may be provided which are arranged on a pivoted axis of said levers and with one leg they press against the receiving body while with the other leg they press against the plunger gripping lever. The arrangement of the syringe gripping levers or plunger gripping levers in radial breakthroughs of the pipette body or receiving body facilitate their actuation from outside. For this purpose, the syringe gripping levers may have operating arms adapted to be activated from outside. These operating arms may be provided with points of contact inside, e.g. release cams, which can be pivoted towards the operating arms of the plunger gripping levers for activating them.

To allow a compensation of tolerances and an automatic ejection of the syringe when loosening the fastening means the abutment for the mounting part may be supported by axially operating spring means in the pipette body.

BRIEF DESCRIPTION OF THE DRAWINGS

Further details and advantages of the invention result from the following description of the accompanying drawings which show preferred embodiments, in which.

DETAILED DESCRIPTION OF THE PREFERRED EMBODIMENTS

Figure 2:
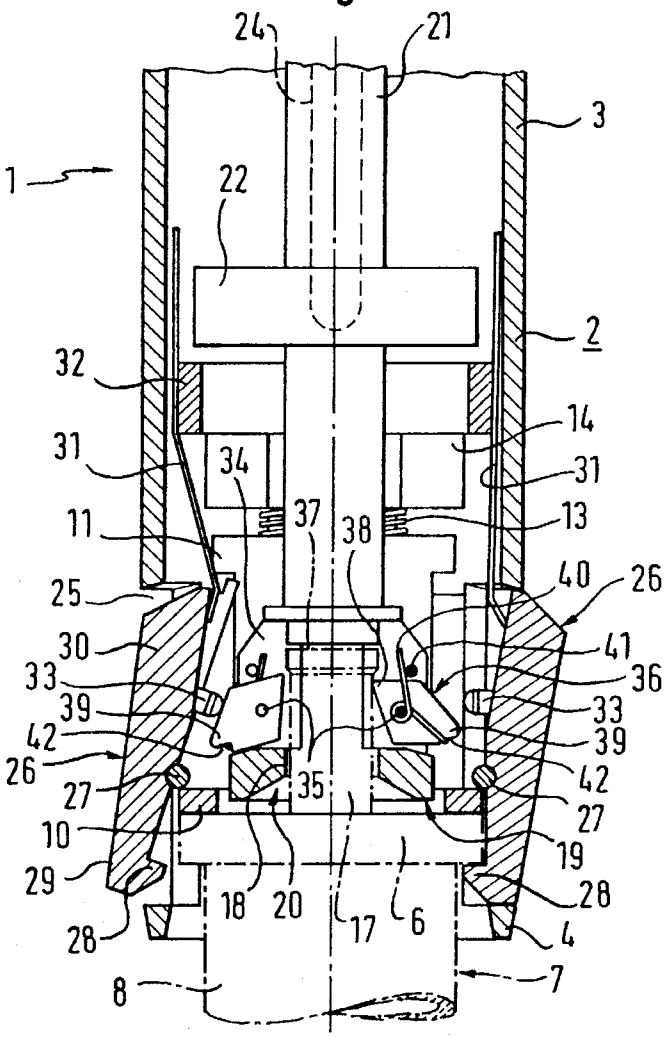
FIG. 2 shows the same repeating pipette system in a section turned about 90° and comprising actuated fastening means (left half) as well as unactuated fastening means (right half)

A repeating pipette 1 according to FIG. 1 and 2 comprises a lower portion 2 of the body with a cylindrical shell 3 and a cone-shaped portion 4 at the lower end "below" and "above" always relates to the alignment of the device in the drawings). In the lower end portion of the lower portion 2 of the body a flange receiving space 5 for a syringe flange 6 of a syringe 7 is arranged. The syringe 7 projects with its syringe body 8 from the bottom of the lower portion 2 of the body through an axial opening 9.

The syringe flange 6 with its upper side engages a flange abutment 10. The flange abutment 10 is formed by two semi-cylindrical halves which at the top are provided with a radially outwardly projecting collar 11. An inner step 12 of the lower portion 2 of the body is associated to the collar 11. Both halves of the flange abutment 10 are supported by ring segments 14 via pressure springs 13 which ring segments 14 engage the inner shell of the lower portion 2 of the body and are tightly connected thereto. The pressure springs 13 are defined as helical springs and are guided by guidance pins 15. These guidance pins 15 are anchored within the collar area of the flange abutment 10 and guided in axial bores 16 of said ring segments 14.

The flange abutment 10 thus forms a grooved abutment for the syringe flange 6.

Furthermore, the syringe 7 with an outwardly projecting end portion of a syringe plunger 17 is inserted into a plunger receiving cavity 18 of an accommodation body 19. Thereat the syringe plunger 17 projects into the receiving body 19 through an axial opening 20 of the plunger receiving cavity 18. The outer end of the syringe plunger 17 abuts against a plunger abutment which is formed by a bottom of the plunger receiving cavity 18.

The receiving body 19 is secured to a lifting rod 21 which with its end in the plunger receiving cavity 18 of the receiving body forms an abutment. The lifting rod 21 is tightly connected to a sliding block 22 which is guided axially on the inner shell of the cylindrical portion 3. Said sliding block 22 comprises a lever 23 for return movement which projects from an axial slot 24 of the lower portion 2 of the body. Thus, the receiving body 19 is axially movable within the lower portion 2 of the body by activation of the lever 23 for return movement.

For fixing the syringe flange 6 in the flange receiving space 5 syringe gripping levers 26 are arranged on pivoted axes 27 in through bores 25 of the lower portion 2 of the body facing each other diametrically. The syringe gripping levers 26 are provided with hook-shaped gripping ends 28 for engaging round the lower portion of the syringe flange 6 whenever the latter engages a lower annular abutment portion of the flange abutment 10. The gripping levers 26 comprising a gripping arm 29 are provided below the pivoted axes 27 approximately in the area of the cone-shaped portion 4 of the lower portion 2 of the body. An operating arm 30 of the gripping levers 26 above the pivoted axes 27 is arranged within the cylindrical shell portion 3 of the lower portion 2 of the body. Thus the gripping lever 26, when engaging round the syringe flange 6, terminates with the outer contour of the cone-shaped portion 4 and can be activated by its operating arm 30.

Two leaf springs 31 engage the inner shell of the cylindrical shell portion 3 which leaf springs 31 at their upper end are supported by an annular body 32 in the lower portion 2 of the body. The lower end of the leaf springs 31 is angled outwardly and presses against the inside of the gripping levers 26. The gripping levers 26 thus are pretensioned by said leaf springs 31 towards the position engaging round the syringe flange 6.

At the inside of their operating arms 30 the syringe gripping levers 26 comprise one release cam 33 each which is directed to the receiving body 19.

The receiving body 19 is also provided with breakthroughs 34 at diametrically opposite sides. In these breakthroughs 34 plunger gripping levers 36 are arranged on pivoted axes 35. The plunger gripping levers 36 can engage round a plunger collar 37 at the extreme end of the syringe plunger 17. Therefor they comprise an approximately wedge-shaped gripping end 38 which is arranged above the pivoted axis 35. Below said pivoted axis 35 an operating arm 39 is provided which tapers approximately wedgelike. The plunger gripping levers 36 thus have an approximately rhomboidal contour all together.

The gripping levers 26, 36 comprise lever arms being of approximately the same length each. The plunger gripping levers 36, however, are shorter than the syringe gripping levers 26.

A leg spring 40 is guided on the pivoted axis 35 of each plunger gripping lever 36. The leg spring 40 with the upper end is supported by an abutment pin 41 which is anchored in the receiving body 19. The other leg of the leg spring 40 comprises an end being angled parallel to he pivoted axis 35 which engages an outside step 42 of the operating arm 39. The leg springs 40 tension the plunger gripping levers 36 towards their position in which they engage round the plunger collar 37. The outside of the operating arm 39 of the plunger gripping levers 36 is formed so that in this locking position it is located within the pivoting area of the actuating cams 33 at the inside of the syringe gripping levers 26. The correct alignment of the plunger gripping levers 36 with the syringe gripping levers 26 is ensured by the guidance of the lever 23 for return movement in the axial slot 24.

The accommodation of a syringe 7 by the repeating pipette 1 can take place as follows: The syringe 7 is ready for insertion, with its syringe flange 6 being directed upwardly. Thereat the syringe plunger 17 can be pressed into the syringe body 8 as deep as possible. By means of the lever 23 for return movement the receiving body 19 of the repeating pipette 1 is pressed towards the flange receiving space 5 as far as possible. The axial movement is restricted by the lever 23 for return movement when abutting against the lower end of the axial slot 24. The repeating pipette 1 is then put on the upper end of the ready syringe 7 from above. Thereat the syringe flange 6 presses the syringe gripping levers 26 outwardly at their bevelled lower edges. Besides, the upper side of the syringe flange presses the flange abutment 10 upwardly. Finally, the hook-shaped gripping ends 28 grip behind the syringe flange 6 and fix the latter to the flange abutment 10.

The insertion of the upper portion of the syringe 7 into the repeating pipette 1 causes the plunger collar 37 to force the plunger gripping levers 36 apart contrary to the action of the leg spring 40 so as to abut against the bottom of the plunger receiving cavity 18. The plunger gripping levers 36 snap in behind the plunger collar 37 while being driven by the leg springs 40 and fix said plunger collar 37 to the bottom of the plunger receiving cavity 18. Thereafter, the syringe body 8 is locked in the repeating pipette 1 and the connection between the syringe plunger 17 and the lifting rod 21 as well as the plunger adjusting means connected thereto is made.

It is also possible to first lock the syringe flange 6 and thereafter connect the syringe plunger 17 to the receiving body 19. For this purpose, after locking the syringe flange 6, the receiving body 19 can be moved over the syringe plunger 17 into the locking position by means of the lever 23 for return movement.

Furthermore, the syringe plunger 17 can be pulled out of the syringe body 8 even further when connecting it to the receiving body 19. This, for instance, is the case when connecting a filled syringe. The receiving body 19 while being in a locking position is located at a corresponding distance from the syringe flange 6. The locking of the syringe plunger 17 then can take place before, during or after the locking of the syringe flange 6.

After locking the syringe 7 to the repeating pipette pipetting can be carried through by actuation of the repeating mechanism which will be more detailedly explained hereinafter.

After pipetting the syringe 7 can be released again. If the syringe plunger 17 is inserted into the syringe body 8 at a maximum, the operating arms 30 of the two syringe gripping levers 26 only need to be pressed inwardly, as shown in the left half of FIG. 2. Thereat their gripping arms 28 release the syringe flange 6. At the same time, the actuating cams 33 of the syringe gripping levers 26 press against the operating arms 39 of the plunger gripping levers 36 causing the latter to release the plunger collar 37. The syringe flange 6 as well as the syringe plunger 17 then are no longer retained in their receiving space and cavity 5, 18, respectively. At the same time, the pretensioned helical springs 13 press the flange abutment 10 towards the axial opening 9 of the repeating pipette so as to eject the syringe 7. The ejection movement of the flange abutment 10 is limited by the abutment of the collar 11 against the inner step 12 of the lower portion 2 of the body.

After release of the syringe 7 the flange gripping levers 26 can be released to cause the leaf springs 31 and the leg springs 40 to move the syringe gripping levers 26 as well as the plunger gripping levers 36 back to their locking position. The pipetting means then is ready for the accommodation of another syringe 7.

In case the syringe plunger 17 does not completely immerse in the syringe body 8, with the syringe gripping levers 26 being actuated, the plunger gripping levers 36 need to be moved into the pivoting area of the cams 33 while removing the syringe 7 so as to allow the syringe plunger 17 to separate from the receiving body 19.

Figure 3:
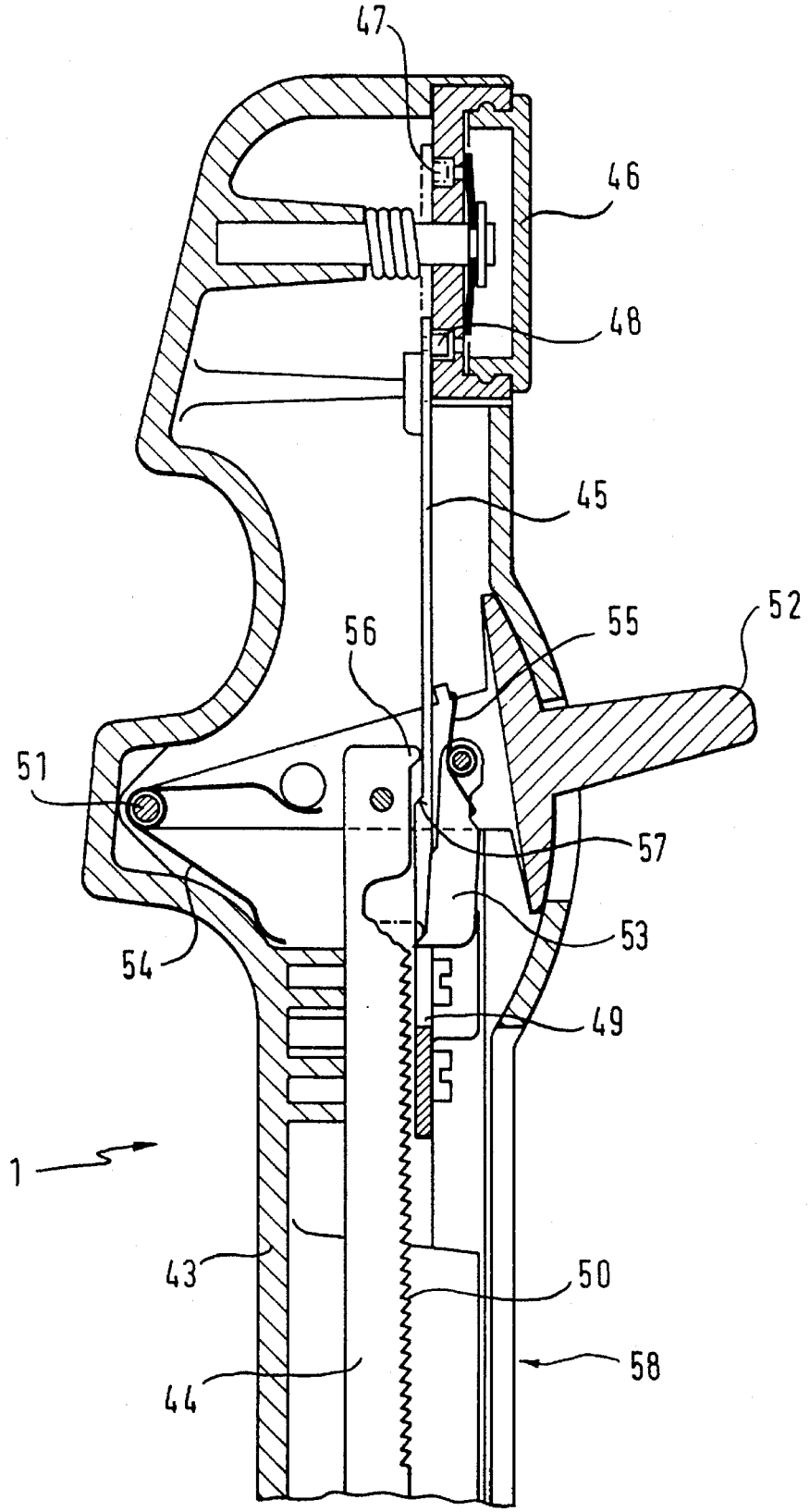
FIG. 3 shows the upper part of the same repeating pipette in cross section.

For the description of a repeating mechanism of the repeating pipette 1 it is referred to FIG. 3. It shows the repeating mechanism known from the DE-C2-29 26 691 which is explained here with respect to its basic structure and its basic functions only.

According to this repeating mechanism, an upper part 43 of the body of the repeating pipette 1 comprises a toothed rack 44 which is tightly connected to the lifting rod 21 (not shown) below. A cover 45 is associated to the toothing of the toothed rack 44 which cover can be variated by means of a rotary knob 46. Therefor the rotary knob 46 comprises a guide curve 47 which cooperates with a guide pin 48 being tightly connected to said cover 45. A change of the position of the rotary knob 46 can cause the cover 45 to more or less engage a toothing 50 of the toothed rack 44 with a lower end 49.

Furthermore, an operating lever 52 is arranged on a pivoted axis 51 in the upper part 43 of the body, on which operating lever 52 in return a detent 53 is mounted pivotally. A spring 54 presses the operating lever 52 into the drawn position and the detent 53 is pretensioned by a tension spring 55 towards the toothed rack 44.

As soon as the operating lever 52 is pressed downwardly the detent pawl 53 engages the toothing 50 of the toothed rack 44 if exceeding the lower end 47 of the cover 45. The adjustment of the cover 45 by means of the rotary knob 46 thus decides at which pivoting angle of the operating lever 52 the toothing 50 is engaged and hence a movement of the toothed rack 44 takes place downwardly. As for each dosing procedure the operating lever 52 is pressed downwardly over its whole pivoting range, the position of the rotary knob 46 is decisive for the distance covered thereat by the toothed rack 44 and the fluid volume discharge thereat by the syringe 7. Furthermore, it is remarkable that the toothed rack comprises an upgrade projection which is capable for forcing away said cover 45 by means of shoulder 57, whereby a further engagement of the detent 53 with the toothing 50 is avoided and a locking means for the residual stroke goes into effect.

Figure 1:
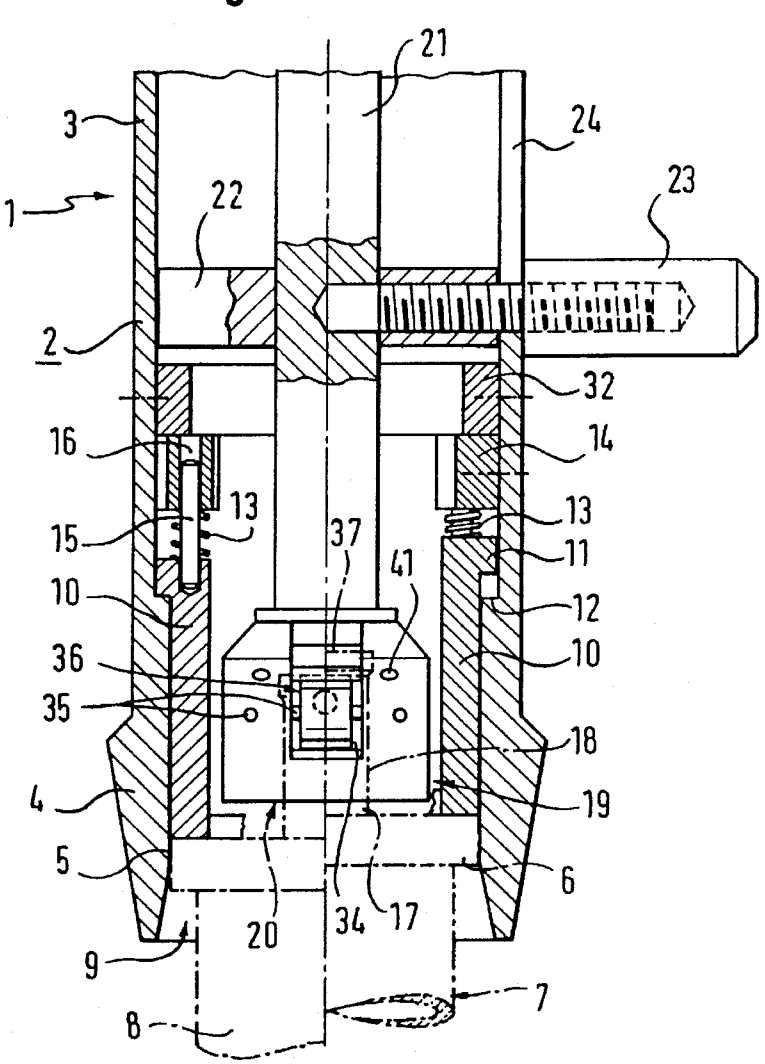
FIG. 1 shows a lower part of a repeating pipette with the upper part of an inserted syringe in cross-section (with completely inserted syringe on the right and partly inserted syringe on the left)

A repeating means 58 according to FIG. 3 together with the return movement lever 23 of FIG. 1 form plunger adjusting means for displacing the receiving body 19 in the pipette body.

We claim:

1. A manual pipette system, comprising:

a replaceable syringe having a syringe body with a mounting part and a plunger;

a manual pipette having a body including means for receiving said syringe mounting part and an axial lifting rod for axial movement within said pipette body with a receiving body at a lower end of said rod having means for receiving means and said plunger receiving means having respective openings through which said mounting part and said plunger move, upon relative axial displacement of said syringe and said pipette, into attachment positions thereof; and fastening means for releasably securing said mounting part and said plunger in the attachment positions thereof;

wherein said fastening means comprises syringe gripping levers pivotally mounted in said pipette body and plunger gripping levers pivotally mounted in said receiving body, wherein each of said syringe and plunger gripping levers has a gripping arm and a manually actuated operating arm, and wherein said operating arms of syringe gripping levers have inwardly extending contact points which, upon actuation of the operating arms of said syringe gripping levers, are pivoted against the operating arms of said plunger gripping levers thereby simultaneously releasing said syringe body and plunger from said pipette.

2. A pipette system according to claim 1, further comprising plunger adjusting means for displacing said receiving body within said pipette body.

3. A pipette system according to claim 1, wherein one of said mounting part receiving means and said plunger receiving means has an abutment means engageable, respectively, by one of said mounting part and said plunger in an attachment position thereof, one of said syringe gripping levers and said plunger gripping levers, respectively, securing said one of said mounting part and said plunger to said abutment means by engaging said abutment means around.

4. A pipette system according to claim 1 wherein said mounting part comprises a syringe flange.

5. A pipette system according to claim 1, wherein said plunger has a collar, said plunger gripping levers engaging around said collar.

6. A pipette system according to claim 1, wherein each of said syringe gripping levers has a hook-shaped gripped end for engaging around said mounting part.

7. A pipette system according to claim 1, wherein each of said plunger gripping levers has a wedge-shaped gripping end for engaging around said plunger.

8. A pipette system according to claim 1, wherein said pipetted body and said receiving body have respective radial breakthroughs, and wherein said syringe and plunger gripping levers are arranged in said respective breakthroughs.

9. A pipette system according to claim 1, wherein gripping and operating arms of respective syringe and plunger gripping levers are substantially identical.

10. A pipette system according to claim 1, wherein said plunger gripping levers have a length which is smaller than a length of said syringe gripping arm.

11. A pipette system according to claim 1, wherein said mounting part receiving means and said plunger receiving means have respective abutment means engageable by said mounting part and said plunger in the attachment positions thereof, said syringe and plunger gripping levers securing said mounting part and said plunger to said respective abutment means by engaging said respective abutment means around.

12. A pipette system according to claim 11, further comprising spring means located in said pipette body for axially supporting the abutment means for said mounting part.

13. A pipette system according to claim 11, further comprising spring means for biasing said syringe and plunger gripping levers to engagement positions thereof.

14. A pipette system according to claim 13, wherein said spring means includes axially extending leaf springs supported in said pipette body and acting on the operating arms of said syringe gripping levers.

15. A pipette system according to claim 13, wherein said receiving body includes an abutment, wherein said spring means includes springs having one legs thereof engaging said abutment and another legs thereof engaging respective operating arms of said plunger gripping levers, and wherein said plunger gripping levers having pivot axes around which said leg springs are guided.

* * * * *